US011369539B2

(12) United States Patent
Ahearn

(10) Patent No.: US 11,369,539 B2
(45) Date of Patent: Jun. 28, 2022

(54) DENTAL CHAIR

(71) Applicant: David J. Ahearn, Little Compton, RI (US)

(72) Inventor: David J. Ahearn, Little Compton, RI (US)

( * ) Notice: Subject to any disclaimer, the term of this patent is extended or adjusted under 35 U.S.C. 154(b) by 0 days.

(21) Appl. No.: 16/863,637

(22) Filed: Apr. 30, 2020

(65) Prior Publication Data

US 2020/0360218 A1 Nov. 19, 2020

Related U.S. Application Data

(60) Provisional application No. 62/847,119, filed on May 13, 2019.

(51) Int. Cl.

| | |
|---|---|
| ***A47C 1/024*** | (2006.01) |
| ***A47C 1/032*** | (2006.01) |
| ***A61G 15/02*** | (2006.01) |
| ***A61G 15/10*** | (2006.01) |

(52) U.S. Cl.

CPC ..... *A61G 15/02* (2013.01); *A61G 15/10* (2013.01)

(58) Field of Classification Search

CPC ..... A61G 15/02; A61G 15/10
USPC ..... 297/330
See application file for complete search history.

(56) References Cited

U.S. PATENT DOCUMENTS 271,596 A * 2/1883 Browne ..... A47C 1/143 297/19
1,373,079 A * 3/1921 King ..... B60N 2/3061 297/344.18
3,554,598 A * 1/1971 Dunkin ..... A61G 15/02 297/330
3,866,973 A * 2/1975 Heubeck ..... A61G 15/02 297/316
3,874,728 A * 4/1975 Weiland ..... A61G 15/02 297/330
3,889,998 A * 6/1975 Weiland ..... A61G 15/02 297/330
3,968,990 A * 7/1976 Heubeck ..... A61G 15/10 297/452.55
3,984,146 A * 10/1976 Krestel ..... A61G 15/02 297/330
4,017,118 A * 4/1977 Cawley ..... A61G 15/10 297/284.3
4,334,710 A * 6/1982 Milner, Jr. ..... A61G 15/002 248/167
4,367,894 A * 1/1983 Manuel ..... A61G 15/002 297/19
D294,891 S * 3/1988 Gyaami ..... D6/360
4,778,216 A * 10/1988 Stupakis ..... A47C 3/40 248/157
5,190,349 A * 3/1993 Austin, Jr. ..... A61G 15/02 297/316

(Continued)

FOREIGN PATENT DOCUMENTS

EP 1652505 A2 * 5/2006 ..... A61G 15/02

*Primary Examiner* — Rodney B White

(74) *Attorney, Agent, or Firm* — Adler Pollock & Sheehan P.C.

(57) ABSTRACT

A dental chair includes a reduced weight and footprint chair module and a reduced weight and footprint lift/base module, the reduced weight and footprint lift/base module configured to releaseably attach to and integrate with the reduced weight and footprint chair module.

5 Claims, 6 Drawing Sheets

(56) References Cited

U.S. PATENT DOCUMENTS

| | | | | | |
|---|---|---|---|---|---|
| 5,214,360 | A * | 5/1993 | Gonser | A61G 15/02 | 297/330 |
| 5,340,953 | A * | 8/1994 | Krebs | A61G 15/02 | 200/5 R |
| 5,547,245 | A * | 8/1996 | Knouse | A61G 5/006 | 297/151 |
| 5,628,546 | A * | 5/1997 | Boetzkes | A61G 15/02 | 297/316 |
| 6,679,905 | B2 * | 1/2004 | Peetros | A61G 13/009 | 606/241 |
| 6,814,409 | B2 * | 11/2004 | Jackson | A61G 15/02 | 297/330 |
| 7,862,123 | B2 * | 1/2011 | Baker | A61G 15/02 | 297/411.33 |
| 8,408,899 | B1 * | 4/2013 | Smith | A61G 15/02 | 433/77 |
| 2010/0109407 | A1 * | 5/2010 | Broering | A61G 15/02 | 297/362.13 |
| 2010/0205742 | A1 * | 8/2010 | Stone | A61G 15/12 | 5/617 |
| 2010/0207432 | A1 * | 8/2010 | Ochsner | A61G 15/10 | 297/188.21 |
| 2011/0195374 | A1 * | 8/2011 | Boren | A61G 15/14 | 433/33 |
| 2015/0320625 | A1 * | 11/2015 | White | A61G 15/12 | 297/344.12 |
| 2021/0077332 | A1 * | 3/2021 | Maynard | F15B 15/2853 | |

* cited by examiner

DENTAL CHAIR

CROSS REFERENCE TO RELATED APPLICATIONS

This application claims priority from U.S. Provisional Application Ser. No. 62/847,119, filed May 13, 2019, the entire disclosure of which is incorporated herein by reference as part of the disclosure of this document.

BACKGROUND OF THE INVENTION

The present invention relates generally to chairs and, in particular to a dental chair.

In general, existing dental patient chairs are large and typically weigh four hundred or more pounds and are manufactured and shipped as a single unit. Such single unit dental chairs are not designed for disassembly. Thus, the heavy weight of dental chairs coupled with the fixed-configuration make them cumbersome and challenging to move and position. In addition, the large size and heavy weight of such dental chairs increases shipping costs associated with transport of the dental chairs.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features a dental including a chair module, a lift module, and a base module, the base module configured to releasably attach to and integrate with the lift module, the lift module configured to releasably attach to and integrate with the chair module.

In another aspect, the invention features a method including providing a chair module with a fastening mechanism, the chair module not exceeding a specified weight, providing a lift module configured to attach to the fastening mechanism of the chair module, the lift module not exceeding the specified weight, and providing a base module configured to attach to the lift module, the base module not exceeding the specified weight.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
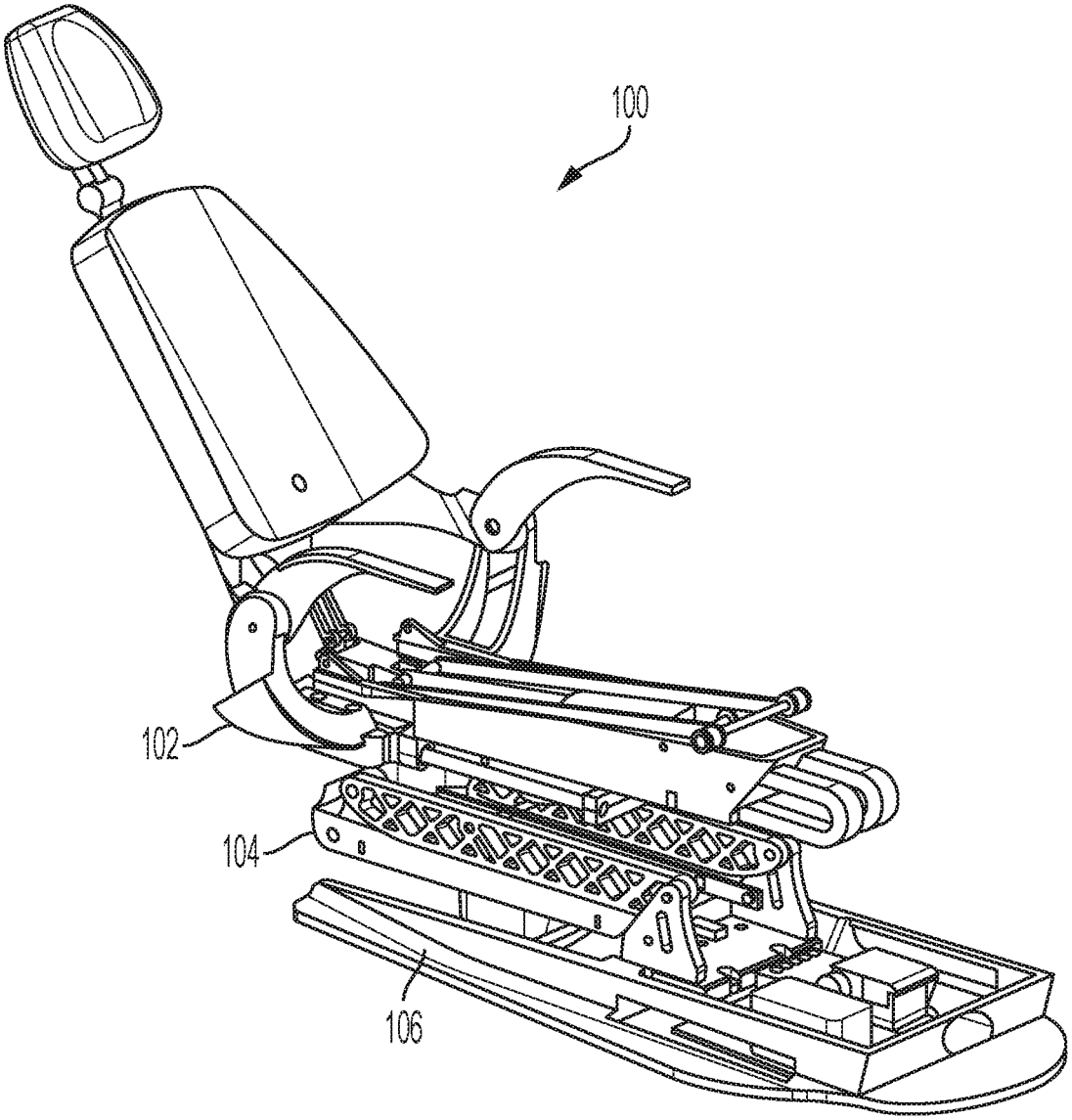
FIG. 1 illustrates an exemplary modular dental chair.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The present invention provides a dental patient chair that includes separate modules which can be easily assembled and disassembled. In contrast to a single-unit dental chair, a reduced weight and footprint of each of the modules makes them less cumbersome and easier to maneuver into place. The dental chair of the present invention substantially reduces shipping costs by enabling a shipping of each module in a separate container using common carriers such as, for example, United Parcel Service (UPS) and FedEx. This avoids the expense of shipping an entire single-unit dental chair that often must use specialized carriers that ship heavy items and charge hefty premiums.

As shown in FIG. 1, an exemplary modular dental chair 100 includes modules that, when linked together as illustrated, form a single integrated unit. More specifically, the modular dental chair 100 includes a chair module 102, a lift module 104, and base module 106. In one embodiment, the modular dental chair 100 includes upholstery (not shown) that is associated with and affixed to the chair module 102. This upholstery provides a user, e.g., dental patient, with back, arm and posterior comfort, for example. Each of the modules 102, 104 and 106, along with appropriate upholstery, if needed, can be shipped separately and assembled on site. Moreover, each of the modules 102, 104 and 106 of the modular dental chair 100 may easily be disassembled for easy transport and shipping purposes. In a preferred embodiment, each individual module 102, 104, 106 is designed to weigh less than one hundred fifty pounds. This weight limit enables each module 102, 104, 106 to be shipped by a standard commercial carrier such as, for example, United Parcel Service ("UPS"). In a specific embodiment, each module 102, 104, 106 is constructed primarily in aluminum or other lightweight metal or composite material.

Figure 2:
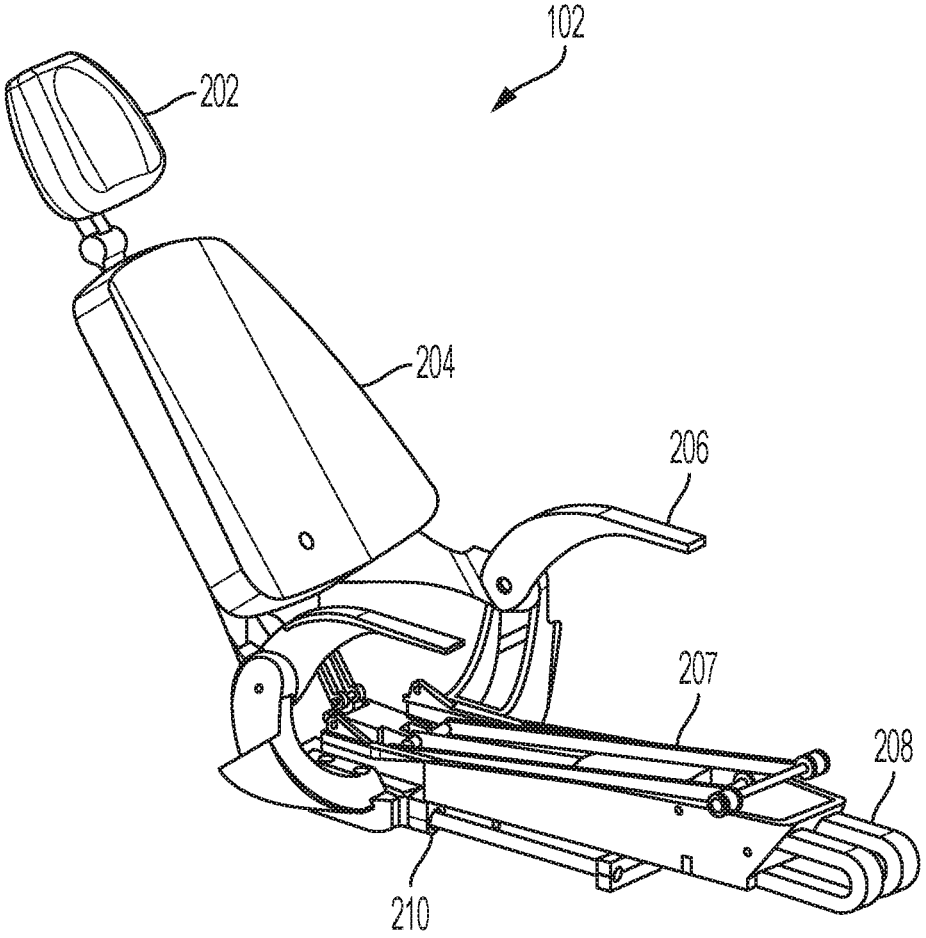
FIG. 2 illustrates an exemplary chair module.

As shown in FIG. 2, the chair module 102 includes at least a head rest assembly 202, a back rest assembly 204, an arm rest assembly 206, a seat assembly 207 and a leg rest assembly 208. The chair module 102 also includes a fastening mechanism 210, such as a threaded cavity or aperture, for releasably attaching the chair module 102 to the lift module 104.

In embodiments, the back rest assembly 204 is linked to the seat assembly 207 to enable movement of the back rest assembly 204 relative to the seat assembly 207.

In embodiments, the head rest assembly 202 and the back rest assembly 204 are slideably linked to each other to enable the head rest assembly 202 to move relative to the back rest assembly 204.

In embodiments, the leg rest assembly 208 is linked to the seat assembly 207 to enable movement of the leg rest assembly 208 relative to the seat assembly 207.

Figure 3:
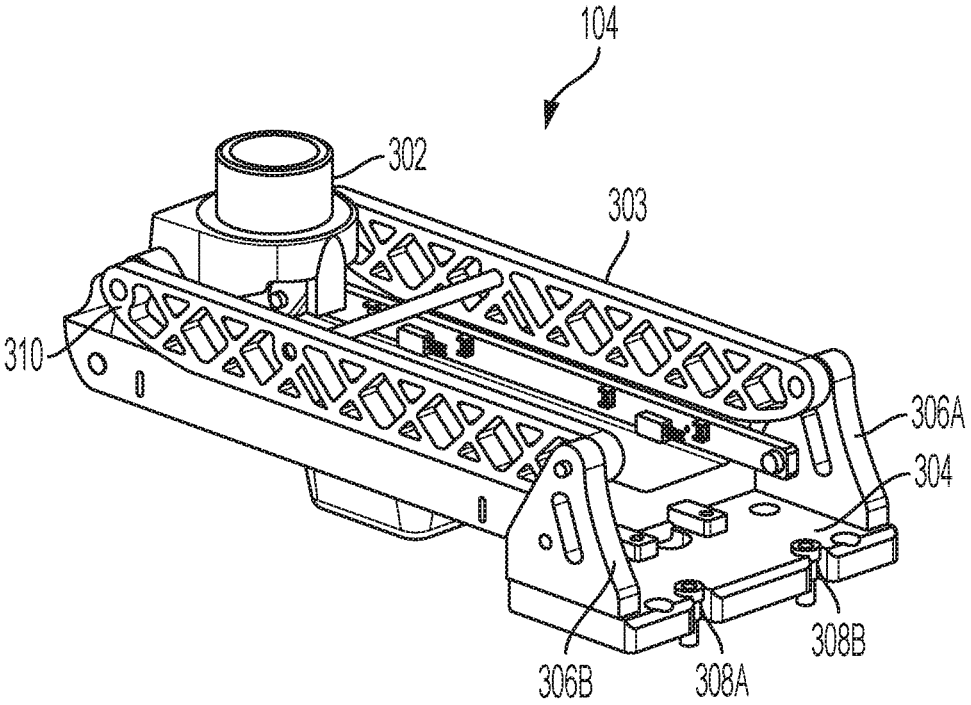
FIG. 3 illustrates an exemplary lift module.

As shown in FIG. 3, the lift module 104 includes a post 302, a lift 303 and a plate 304. The lift 303 is attached to plate towers 306A, 306B on its proximal end which enable to lift 303 to be raised and lower as it rotates on the plate towers 306A, 306B. The post 302 is attached to a distal end of the lift 303 and is configured to removably attach to the fastening mechanism 210 of the chair module 102. Once attached, the lift module 104 can raise, lower or otherwise maneuver the chair module 102.

The post 302, in an embodiment, is cylindrical in shape and made of metal or other material. The post 302 is utilized to securely attach the chair module 102 onto the lift module 104. In one embodiment, for further convenience, the post 302 can be threaded to mate with a complementary threaded fastening mechanism 210 on chair module 102.

The plate 304 is utilized to attach the lift module 104 to the base module 106. The plate 304 is configured to align with the base plate 402. The plate 304 can include multiple keyed apertures 308A, 308B that align with the fasteners (shown below) on the base plate module 106. In addition, the distal end of the lift 303 can include posts 310 designed to mate with the seat module 102 and aid in its attachment to the seat module 102.

Figure 4:
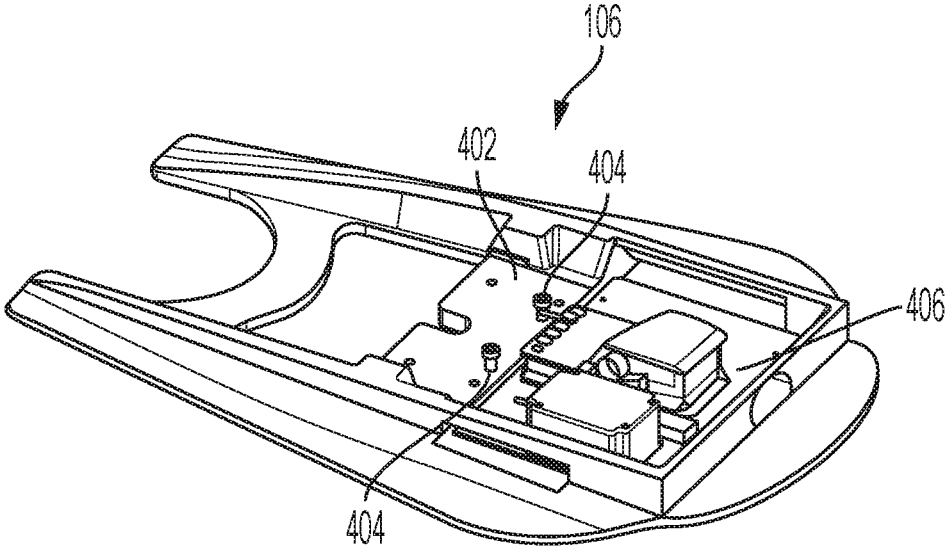
FIG. 4 illustrates an exemplary base module.

As shown in FIG. 4, the base module 106 includes at least a plate 402 and fasteners (such as bolts) 404. The plate 402 receives and secures to the lift module 104 using the fasteners 404 which are engaged in the apertures 308A, 308B. The base plate 402 also includes an electronics section 406 housing electronics that power the movements of the lift module 104 and additional features.

Figure 5:
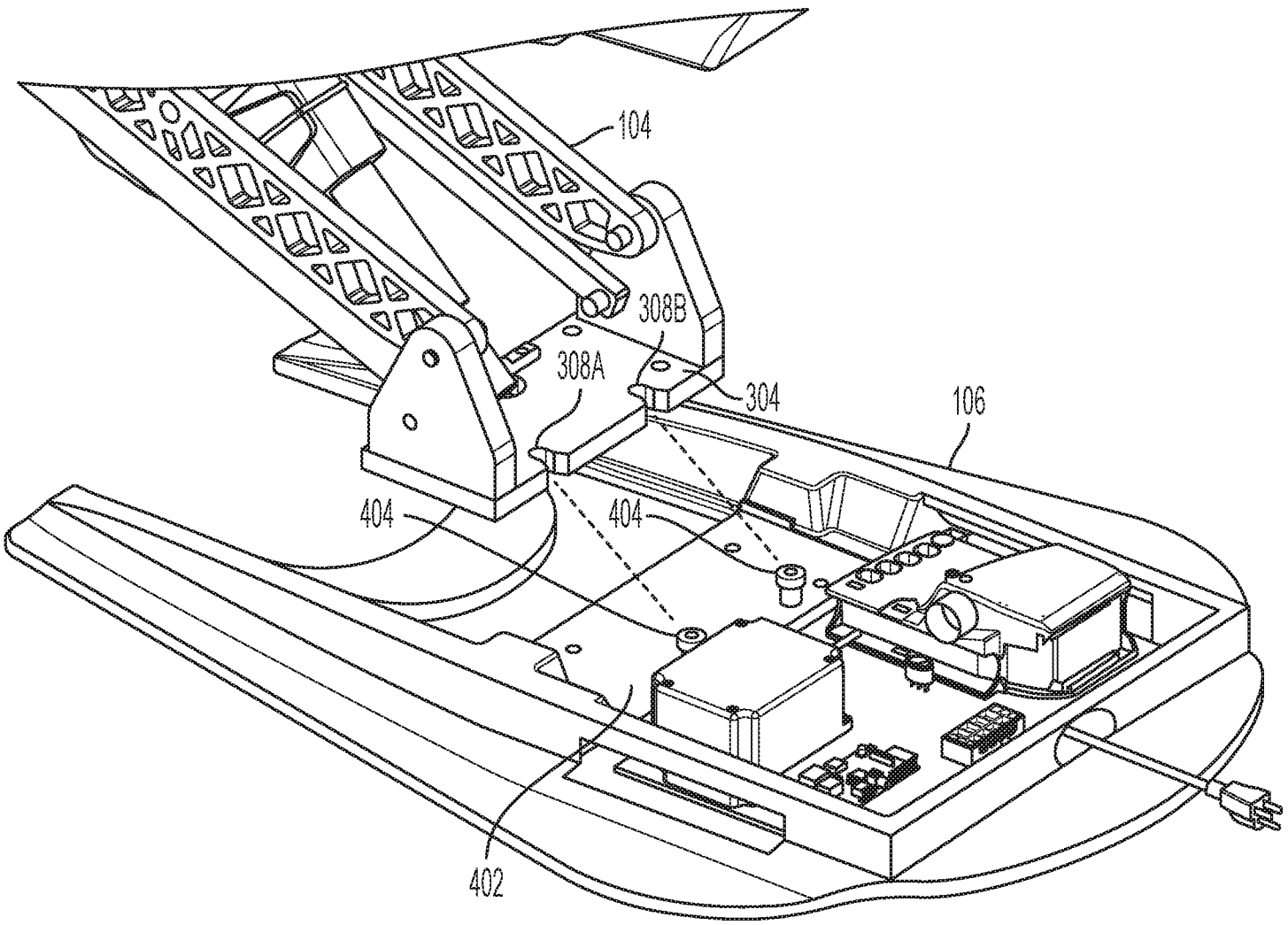
FIG. 5 illustrate lift and base modules.

In FIG. 5, the lift module 104 is shown being lowered onto the base module 106 such that the plate 304, when joined together, results in having the plate 304 flush against the plate 402 with the fasteners 404 on plate 402 aligned and secured in the keyed apertures 308A, 308B on the plate 304.

Figure 6:
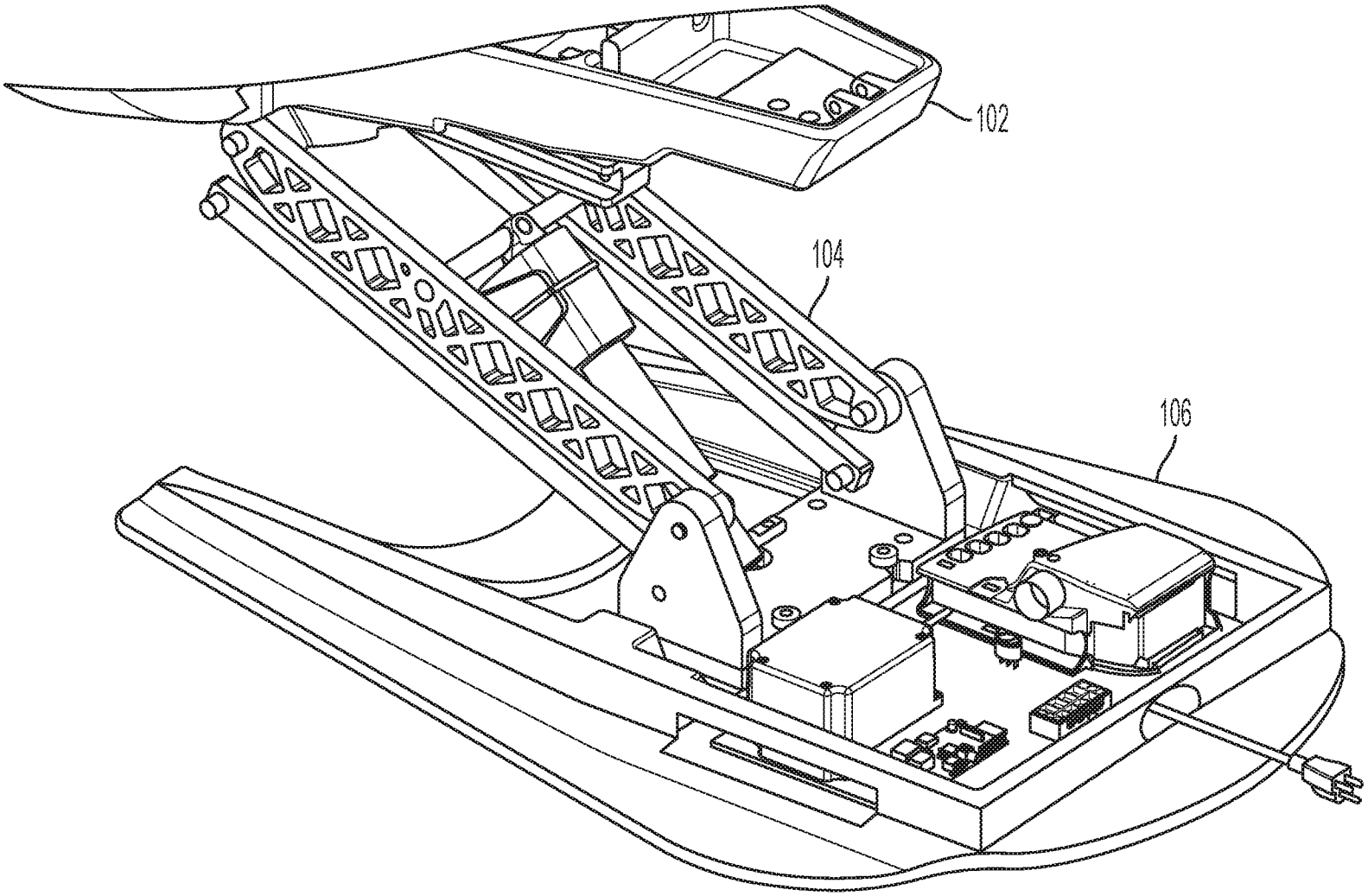
FIG. 6 illustrates chair, lift and base modules.

FIG. 6 illustrates the joining of the lift module 104 with the base module 106.

Figure 7:
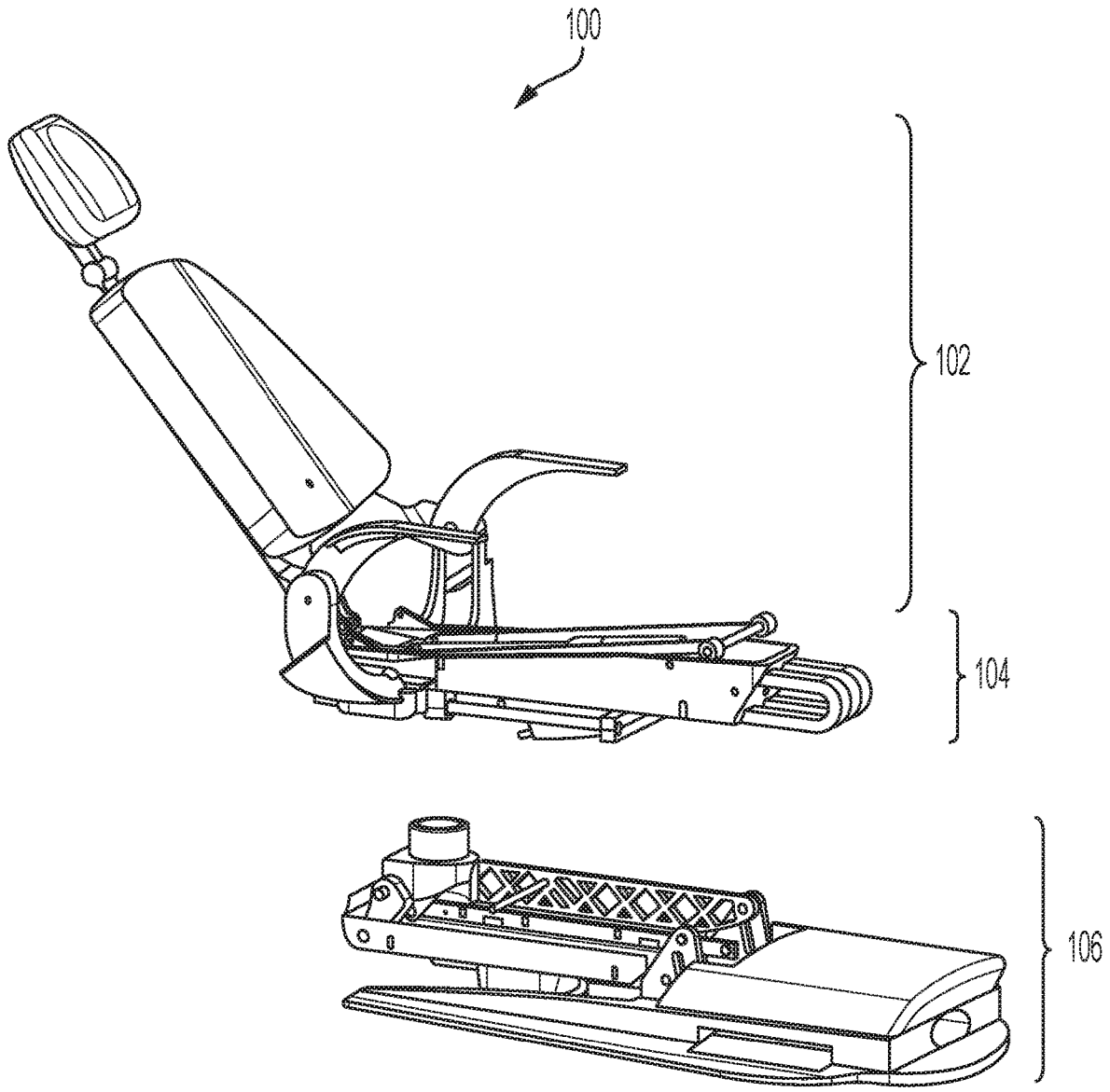
FIG. 7 illustrates an exemplary alignment of chair, lift and base modules.

FIG. 7 illustrates alignment of the chair module 102 over the lift module 104 and the base module 106.

While the present invention has been described with reference to certain embodiments thereof, it should be understood by those skilled in the art that various changes may be made and equivalents may be substituted without departing from the true spirit and scope of the invention. In addition, many modifications may be made to adapt to a particular situation, indication, material and composition of matter, process step or steps, without departing from the spirit and scope of the present invention. All such modifications are intended to be within the scope of the present invention.

What is claimed is:

1. A modular dental chair comprising:

a chair module;

a lift module;

a base module, wherein the chair module comprises a head rest assembly, a back rest assembly, an arm rest assembly, a seat assembly, a leg rest assembly and a fastening mechanism configured to releasably attach the chair module to the lift module, and wherein the lift module comprises a post, a lift and a lift module plate, the lift having a proximal end, the lift attachable to plate towers located on the lift module plate that enable the lift to be raised and lowered as the lift rotates on the plate towers, wherein the base module comprises a base plate and base fasteners, the lift module plate including open front keyed apertures, the base plate configured to receive and secure to the lift module plate using oversized heads of the base fasteners that are aligned and secured in the open front keyed apertures of the lift module plate to prevent a vertical axial movement of the lift module plate upon the base plate of the base module.

2. The modular dental chair of claim 1 wherein the lift module post is attached to a distal end of the lift and is configured to removably attach to the fastening mechanism of the chair module.

3. The modular dental chair of claim 2 wherein the post is cylindrical in shape and constructed of metal or other material.

4. The modular dental chair of claim 2 wherein the post is threaded to mate with a corresponding threaded cavity of the fastening mechanism on chair module.

5. The modular dental chair of claim 2 wherein the base plate includes an electronics section housing electronics that power movements of the lift module and additional features.

* * * * *